US006938861B1

(12) United States Patent
Ballard et al.

(10) Patent No.: US 6,938,861 B1
(45) Date of Patent: Sep. 6, 2005

(54) BABY BOTTLE HOLDER

(76) Inventors: Lori M. Ballard, 1644 Bobs Creek Rd., Zirconia, NC (US) 28790; Jason L. Ballard, 1644 Bobs Creek Rd., Zirconia, NC (US) 28790

( * ) Notice: Subject to any disclaimer, the term of this patent is extended or adjusted under 35 U.S.C. 154(b) by 0 days.

(21) Appl. No.: 10/911,666

(22) Filed: Aug. 5, 2004

(51) Int. Cl.[7] ..... A47D 15/00; A61J 9/06
(52) U.S. Cl. ..... 248/104; 248/106
(58) Field of Search ..... 248/102, 103, 248/104, 105, 106; D24/199

(56) References Cited

U.S. PATENT DOCUMENTS

| | | | | | |
|---|---|---|---|---|---|
| 2,258,076 | A | | 10/1941 | Taylor et al. | 248/104 |
| 3,058,708 | A | * | 10/1962 | Murray et al. | 248/102 |
| 3,289,986 | A | * | 12/1966 | Martin | 248/103 |
| 3,603,551 | A | * | 9/1971 | Peterson | 248/314 |
| 3,696,233 | A | | 10/1972 | Pulsifer | 219/535 |
| 4,114,847 | A | * | 9/1978 | Bogensberger | 248/104 |
| 4,320,883 | A | * | 3/1982 | Bass | 248/104 |
| D266,273 | S | | 9/1982 | Bass | D24/199 |
| D273,044 | S | | 3/1984 | Holcomb | D24/199 |
| 4,733,836 | A | | 3/1988 | Barnes | 248/106 |
| 5,092,549 | A | | 3/1992 | Beech | 248/103 |
| D337,162 | S | | 7/1993 | Rollins | D24/199 |
| 5,489,486 | A | * | 2/1996 | Glover | 429/100 |
| D369,413 | S | | 4/1996 | Lodewyck, Jr. et al. | D24/199 |
| D375,796 | S | | 11/1996 | Beaver | D24/199 |
| 5,823,486 | A | * | 10/1998 | Smith et al. | 248/104 |
| 6,250,592 | B1 | * | 6/2001 | Davis | 248/104 |

FOREIGN PATENT DOCUMENTS

| | | | |
|---|---|---|---|
| FR | 2 666 505 | A1 * | 3/1992 |
| GB | 2 170 410 | A * | 8/1986 |
| JP | 3-51007 | A * | 5/1991 |

* cited by examiner

*Primary Examiner*—Jonathon Szumny
(74) *Attorney, Agent, or Firm*—Donald R. Schoonover

(57) ABSTRACT

A baby bottle holder includes a clamp unit that is used to support the unit on a stroller or the like, a support section that is flexible, and a bottle-engaging unit that has a liquid filled peripheral section and a flexible central section. A cross hair shaped slot unit is defined through the flexible central section and accommodates a baby bottle therein. Toys, mirrors and/or teething elements are supported on the bottle-engaging unit. The liquid in the peripheral section can be a glow-in-the-dark type liquid.

4 Claims, 1 Drawing Sheet

BABY BOTTLE HOLDER

BACKGROUND OF THE INVENTION

1. Field of the Invention

The present invention relates to the general art of supports, and to the particular field of baby bottle holders.

2. Discussion of the Related Art

Nearly all parents and child care givers have experienced the problem of a child or multiple children that choose(s) to become fussy when the care giver is otherwise occupied. This situation often occurs when the care giver is driving and the child is in a car seat. However, the situation also occurs when the care giver is pushing the child in a cart or stroller.

The situation can often be ameliorated by giving the child a bottle or a toy. However, this is not always as easy as it sounds because the child may drop the bottle or become bored with the bottle or toy and resume their fussiness. In this case, the care giver must continually face backwards in a physically straining position for long periods of time to hold a bottle for a fully dependant infant or to adjust the bottle or retrieve the toy or the bottle if the child drops it. If the care giver is driving, this is not possible, or may be dangerous if the parent tries to replace the bottle or toy while driving. However, if the bottle or toy is not replaced, the child's fussiness may distract the driver, which, also is not a safe situation.

Therefore, there is a need for a baby bottle support.

While the art contains may examples of baby bottle supports, many of these supports are not convenient for either the baby or the care giver, or both. The bottle holders of the prior art may not be amendable to use on both a stroller and a cart and on a car baby seat. Still further, some of the prior art baby bottle supports may not be adaptable for various positions of the baby, or may not be amenable to change if the baby moves. Still further, some baby bottle supports of the prior art are useful for small infants but are not useful for larger babies.

Therefore, there is a need for a baby bottle support that can be located to be convenient to both a baby and a care taker.

Baby bottles come in a wide variety of bottles and bottle shapes. For example, a juice bottle may be different from a formula bottle, and the like. A baby prefers specific and varying bottles and nipples. Some baby bottle holders of the prior art may be amendable to formula bottles, but may not accommodate juice bottles, or may not be easily adapted to accommodate such juice bottles. Accordingly, a care giver may be required to have several different baby bottle holders.

Therefore, there is a need for a baby bottle support that can accommodate a wide variety of baby bottles.

A baby's attention span may be quite short. After a short time, a baby may become fussy simply from boredom rather than hunger and a baby bottle may be rejected. Many prior art baby bottle holders simply hold a baby bottle and thus will not approach this problem.

Therefore, there is a need for a baby bottle support that will be attractive to the baby.

PRINCIPAL OBJECTS OF THE INVENTION

It is a main object of the present invention to provide a baby bottle support.

It is another object of the present invention to provide a baby bottle support that is portable and compact and simple for a caretaker to use and that can be located to be convenient to both a baby and a care taker.

It is another object of the present invention to provide a baby bottle support that can accommodate a wide variety of baby bottles.

It is another object of the present invention to provide a baby bottle support that will be attractive to the baby and stimulate the senses to thereby encourage early learning.

SUMMARY OF THE INVENTION

These, and other, objects are achieved by a baby bottle holder that can be clamped to a stroller, a cart, a car seat, or the like and includes a flexible support element as well as a flexible bottle engaging portion. The flexible bottle engaging portion includes a liquid-filled peripheral section and a flexible central section having a cross hair shaped slot defined therein. The slot combines with the flexible material of the central section to accommodate a wide variety of baby bottles, and the liquid in the peripheral section can be a glow-in-the-dark type liquid. Various toys, mirrors, teething elements, and the like, are supported from the baby bottle holder of the present invention.

Using the baby bottle holder embodying the present invention will permit a baby bottle holder that can be located in a manner that is convenient to both the baby and to a care giver and will accommodate a wide variety of baby bottles in a manner that is attractive to the baby whereby the baby is less likely to lose interest in the bottle.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a baby bottle holder 10 that achieves the above-stated objectives.

Figure 2:
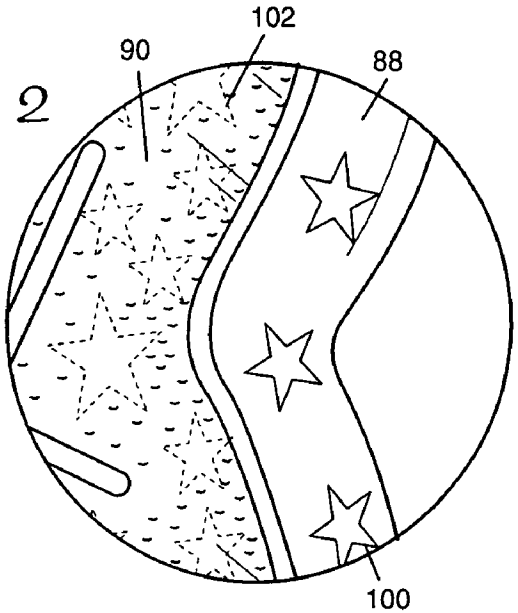
FIG. 2 shows a portion of the baby bottle-engaging unit included in the baby bottle holder embodying the present invention.
Figure 1:
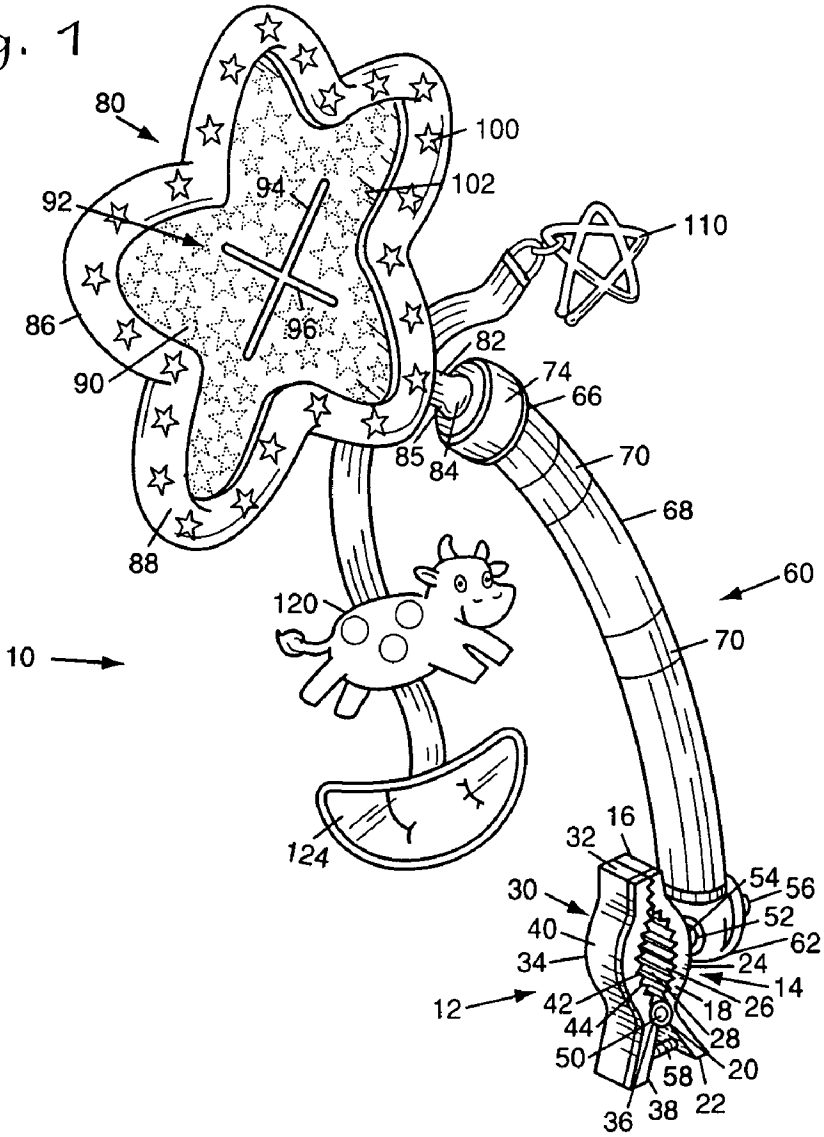
FIG. 1 is a perspective view of a baby bottle holder embodying the present invention.

Baby bottle 10 comprises a clamp unit 12 which includes a first section 14 which has a pincer section 16, a concave portion 18, a pivot connection portion 20, and a tail portion 22. A first surface 24 is an outside surface when clamp unit 12 is in a use orientation as shown in FIG. 1, and a second surface 26 that is an inside surface when clamp unit 12 is in use. Corrugations 28 are located on the inside surface 26 for improving the gripping action of the clamp unit 12.

Clamp unit 12 further includes a second section 30 which has a pincer section 32 which is located adjacent to pincer section 16 of first section 14 when clamp unit 12 is in use, a concave portion 34 which is located adjacent to concave portion 18 of first section 14 when clamp unit 12 is in use, a pivot connection portion 36 which is located adjacent to pivot connection 20 of first section 14 when clamp unit 12 is in use, and a tail portion 38 which is located adjacent to tail portion 22 of first section 14 when clamp unit 12 is in use.

Second section 30 further includes a first surface 40 that is an outside surface when clamp unit 12 is in use and a second surface 42 that is an inside surface when clamp unit 12 is in use. Corrugations, such as corrugation 44, are located on the inside surface 42 of second section 30 and co-operate with corrugations 28 to firmly clasp onto a support element, such as a cart, a car seat, a carrier or the like.

A pivot pin 50 pivotally connects first section 14 to second section 30, and a mounting element 52, such as a pin or the like, has a first end 54, fixedly mounted to outside surface 24 of first section 14 adjacent to concave portion 18 of first section 14, and a second end 56, spaced apart from first end 54. A spring 58 is interposed between pivot pin 50 and the pincer sections 16, 32 to bias the pincer sections 16, 32 toward each other to hold the clamp unit 12 in position on a support surface.

Baby bottle holder 10 further includes a flexible support element 60. Flexible support element 60 includes a first end 62 that is a bottom end when support element 60 is in a use orientation such as shown in FIG. 1. Second end 56 of mounting element 52 is fixedly secured to first end 62 of support element 60. Support element 60 further includes a second end 66 which is a top end when support element 60 is in use.

The flexible support element 60 further includes an outer surface 68 which can be multicolored with colored sections, such as section 70, to hold a baby's attention.

A swivel pivot connection 74 is located in second end 66 of support element 60.

A bottle-engaging unit 80 is mounted on support element 60 and includes a pivot pin 82 having a swivel ball 84 on one end 85. Swivel ball 84 is accommodated in swivel pivot connection 74 of support element 60. Unit 80 further includes a body unit 86 mounted on pivot pin 82. Body unit 86 includes a peripheral section 88 filled with liquid, such as a glow-in-the-dark liquid which may be a phosphorescent type material or the like as will be understood by those skilled in the art based on the teaching of the present disclosure. The selected liquid is a suitable child-safe substance.

Body unit 86 further includes a central section 90 which is located within peripheral section 88 to be surrounded thereby. Central section 90 is formed of flexible material, such as rubber, and includes a baby bottle-receiving slot 92 defined therein. If desired, the material may be textured to thereby enable a firmer grip; for example such texturing may be provided with designs such as star-shaped embossings. Slot 92 has a first slot section 94 and a second slot section 96 that intersects first slot section 94 and which is oriented perpendicular to first slot section 94 to define a cross hair configuration. The flexible nature of central section 90 permits slot 92 to deform to accommodate bottles of different shapes and sizes whereby baby bottle holder 10 is quite versatile.

Decorations, such as stars 100 and 102 can be placed on the various sections of bottle-engaging unit 80 to further attract and hold a child's attention, including toy beads that can travel along a flexible path. If desired, the various decorations may be designed to suit a particular theme.

Baby bottle holder 10 further includes a toy attachment element 110 mounted on bottle-engaging unit 80 whereby various toys, such as musical, action lighted, and noise-generating toys, can be releasably attached to the body unit 86 by a toy link.

A teething element 120 is mounted on the bottle-engaging unit and a mirror unit 124 is also mounted on the teething element 120. The mirror unit 124 will hold a child's attention and may also permit an adult to monitor a child.

It is understood that while certain forms of the present invention have been illustrated and described herein, it is not to be limited to the specific forms or arrangements of parts described and shown.

What is needed and desired to be covered by Letters Patent is as follows:

1. A baby bottle holder comprising:

(a) a clamp unit which includes
- (1) a first section having
  - (A) a pincer section,
  - (B) a concave portion,
  - (C) a pivot connection portion,
  - (D) a tail portion,
  - (E) a first surface that is an outside surface when said clamp unit is in use, and
  - (F) a second surface that is an inside surface when said clamp unit is in use,
- (2) a second section having
  - (A) a pincer section which is located adjacent to the pincer section of the first section when said clamp unit is in use,
  - (B) a concave portion which is located adjacent to the concave portion of the first section when said clamp unit is in use,
  - (C) a pivot connection portion which is located adjacent to the pivot connection of the first section when said clamp unit is in use,
  - (D) a tail portion which is located adjacent to the tail portion of the first section when said clamp unit is in use,
  - (E) a first surface that is an outside surface when said clamp unit is in use, and
  - (F) a second surface that is an inside surface when said clamp unit is in use,
- (3) a pivot pin pivotally connecting the first section to the second section, and
- (4) a mounting element having a first end fixedly mounted to the outside surface of the first section adjacent to the concave portion of the first section and a second end spaced apart from the first end of the mounting element;

(b) a flexible support element which includes
- (1) a first end which is a bottom end when said support element is in use, the second end of the mounting element of said clamp unit being fixedly secured to the first end of said support element,
- (2) a second end which is a top end when said support element is in use, and
- (3) a swivel pivot connection in the second end of said support element;

(c) a bottle-engaging unit mounted on said support element and including
- (1) a pivot pin having a swivel ball on one end, the swivel ball being accommodated in the swivel pivot connection in the second end of said support element, and
- (2) a body unit mounted on the pivot pin and having
  - (A) a peripheral section filled with a glow in the dark liquid,
  - (B) a central section within the peripheral section, the central section being formed of flexible material, and including a baby bottle receiving slot which has a first slot section and a second slot section that intersects the first slot section and which is oriented perpendicular to the first slot section;

(d) a toy attachment element mounted on said bottle-engaging unit;

(e) a teething element mounted on said bottle-engaging unit; and (f) a mirror unit mounted on said teething element, the mirror is adapted to be used by a care giver to monitor or entertain a child.

2. The baby bottle holder as described in claim 1 further including multi-color decoration on said support element.

3. The baby bottle holder as described in claim 1 wherein the flexible material of said body unit is rubber.

4. The baby bottle holder as described in claim 3 wherein the liquid in the peripheral section of said bottle-engaging unit is phosphorescent material.

* * * * *